United States Patent [19]

Berry et al.

[11] Patent Number: 4,458,747

[45] Date of Patent: Jul. 10, 1984

[54] DIRECT-CONTACT CLOSED-LOOP HEAT EXCHANGER

[75] Inventors: Gregory F. Berry, Naperville; Vladimir Minkov, Skokie; Michael Petrick, Joliet, all of Ill.

[73] Assignee: The United States of America as represented by the United States Department of Energy, Washington, D.C.

[21] Appl. No.: 317,706

[22] Filed: Nov. 2, 1981

[51] Int. Cl.[3] ..... F28D 15/00

[52] U.S. Cl. ..... 165/104.29; 165/104.19; 165/111; 165/104.32

[58] Field of Search ..... 165/104.29, 104.19, 165/111, 104.32

[56] References Cited

U.S. PATENT DOCUMENTS 1,935,053 11/1933 Jaeger ..... 165/104.29 X 3,615,079 10/1971 DeLara et al. ..... 165/104.29 X

*Primary Examiner*—Albert W. Davis, Jr.

*Attorney, Agent, or Firm*—Charles F. Lind; Bruce R. Mansfield

[57] ABSTRACT

A high temperature heat exchanger with a closed loop and a heat transfer liquid within the loop, the closed loop having a first horizontal channel with inlet and outlet means for providing direct contact of a first fluid at a first temperature with the heat transfer liquid, a second horizontal channel with inlet and outlet means for providing direct contact of a second fluid at a second temperature with the heat transfer liquid, and means for circulating the heat transfer liquid.

14 Claims, 14 Drawing Figures

DIRECT-CONTACT CLOSED-LOOP HEAT EXCHANGER

CONTRACTUAL ORIGIN OF THE INVENTION

The U.S. Government has rights in this invention pursuant to Contract No. W31-109-ENG-38 between the U.S. Department of Energy and the University of Chicago representing Argonne National Laboratory.

BACKGROUND OF THE INVENTION

In a broad sense, a heat exchanger is a device used to bring the temperatures of two fluids closer together. The fluids can be gases or liquids, or mixtures of gases and liquids. In most cases, the sole purpose of the heat exchanger is to heat or cool only one of the fluids to within a specific range of temperatures, and the range of temperatures of other fluid is immaterial. In some cases, it is desired to maintain both fluids within specific respective ranges of temperatures. There are two common classifications of heat exchangers: recuperative and regenerative. In the recuperative heat exchanger, the two fluids are isolated from one another in separate confinements by fluidtight thermally conductive walls. In the regenerative heat exchanger, the fluids alternately occupy the same confinement and are isolated from one another by valves which allow each fluid to alternately pass through In a recuperative heat exchanger, the total heat transfer between the two fluids is a function of and varies because of many factors including the heat transfer between each fluid and the separating walls, which varies typically because of fouling and scaling, the thermal conductivity of the separating walls, and the temperature difference between the fluids. The fluids are generally moved relative to the separating walls which increases the effective output of the heat exchanger. Each fluid is further operating generally within a design range of temperatures, pressure and flow rates; and there are temperature, pressure and flow rate differentials between the fluids.

The regenerative heat exchanger provides that the two fluids can alternately be circulated over a common heat transfer medium. Thus the first fluid (assuming the first fluid is hot and is to be cooled) is passed over the medium to heat the medium and this first fluid is thereby cooled; whereupon the second fluid is then passed over the heated medium to cool the medium, while the second fluid is thereby heated.

Many problems arise for heat exchanger designs capable of operating at temperatures up to 2500° C. and pressure differentials up to several atmospheres. One such problem relates to the materials needed for holding the fluids and/or for moving the fluids about or through the heat exchanger. For instance, most structural steels melt at temperatures in the range of 1350°-1600° C., so that more costly metallic material or high temperature ceramics must be used. Further, when high temperatures and large pressure differentials are involved, the heat exchanger structures become heavier, and the thicker separating walls of a recuperative heat exchanger reduce in direct proportion the effective heat transfer between the fluids. This creates a greater temperature differential as between the two fluids, and requires even larger heat exchanger constructions. The operating temperatures of pumps are frequently held below 400°-600° C., so that few mechanical pump designs are available for circulating the fluids, particularly for pumps of large flow and/or pressure requirements.

The cyclical heating and cooling of the components of the regenerative heat exchanger, especially at very high temperatures, greatly shortens the expected operating life of the unit. Further, the cyclical operation requires that at least two such heat exchangers be arranged in parallel flow circuits with the two fluids (if there is to be continuous flow of either fluid through the heat exchanger system), and the valving is used for directing the first and second fluids alternately through the separate heat exchangers. Moreover, ineffective heat transfer between the fluids and heat transfer medium, and the limited capacity of the heat transfer medium to give up or absorb heat during any single cycle keep the temperature differential between the fluids quite high. The overall effectiveness of this type heat exchanger thereby is quite low.

SUMMARY OF THE INVENTION

This invention relates to an improved hybrid type heat exchanger that can be used for two isolated fluids, even for fluids operating at high temperatures up to and above 2500° C. and possibly large pressure differentials, while yet having effective small incoming and exiting temperature differences between the two fluids.

A basic object of this invention is to provide a heat exchanger that uses two separate fluids, as well as a common heat transfer medium which is continuously but alternately exposed to or admixed directly with each of the fluids, whereby highly effective heat transfer relationship is established between the fluids and the heat transfer medium.

A more detailed object of this invention is to provide a heat exchanger that allows for the effective cooling of a very high temperature "hot" fluid and/or the effective heating of a "cold" a very high temperature, particularly by allowing a direct admixture with or contact of the fluids with a circulating heat transfer medium in the heat exchanger.

A specific feature of the disclosed heat exchanger is a continuous loop having separate channel sections and separate column sections interconnecting the channel sections to one another, whereby a heat transfer medium is circulated unidirectionally around the loop and whereby a separate fluid is admitted into each channel, is exposed to or admixed in good heat transfer relation with the heat transfer medium therein, and further is discharged from the channel before entering the successive column. The particular heat transfer medium can typically be in the form of a liquid that remains in its liquid phase even at the inlet temperatures of the hot and cold fluids.

Another feature of the disclosed heat exchanger is that the channel sections can be located at different elevations and the interconnecting column sections can be oriented vertically, so that the heat transfer medium (because of the gravity effect) is at different pressures in the upper and lower channel sections. This accommodates thereby the heat transfer between two fluids at different pressures, generally corresponding respectively to the medium pressures of the separate channel sections. With a heat transfer medium such as liquid copper oxide ($Cu_2O$) having a specific gravity in excess of 6.0, a pressure differential of one atmosphere can be established for each 1.6 meters approximately of height differential between the upper and lower channel sections. The operating temperature range of copper oxide would be in the general range of 1235° C. and 1800° C., where it is in the liquid phase.

The heat transfer medium liquid is circulated unidirectionally about the loop by the axial parallel movement of either or both fluids in the respective loop channel sections, and/or by axially directed jet injectors located within the loop. The jet discharge of air, for example, in one column section creates an upward movement in that column section of the heat transfer medium and the corresponding unidirectional circulation of the heat transfer medium around the loop.

DETAILED DESCRIPTION OF THE INVENTION

Figure 1:
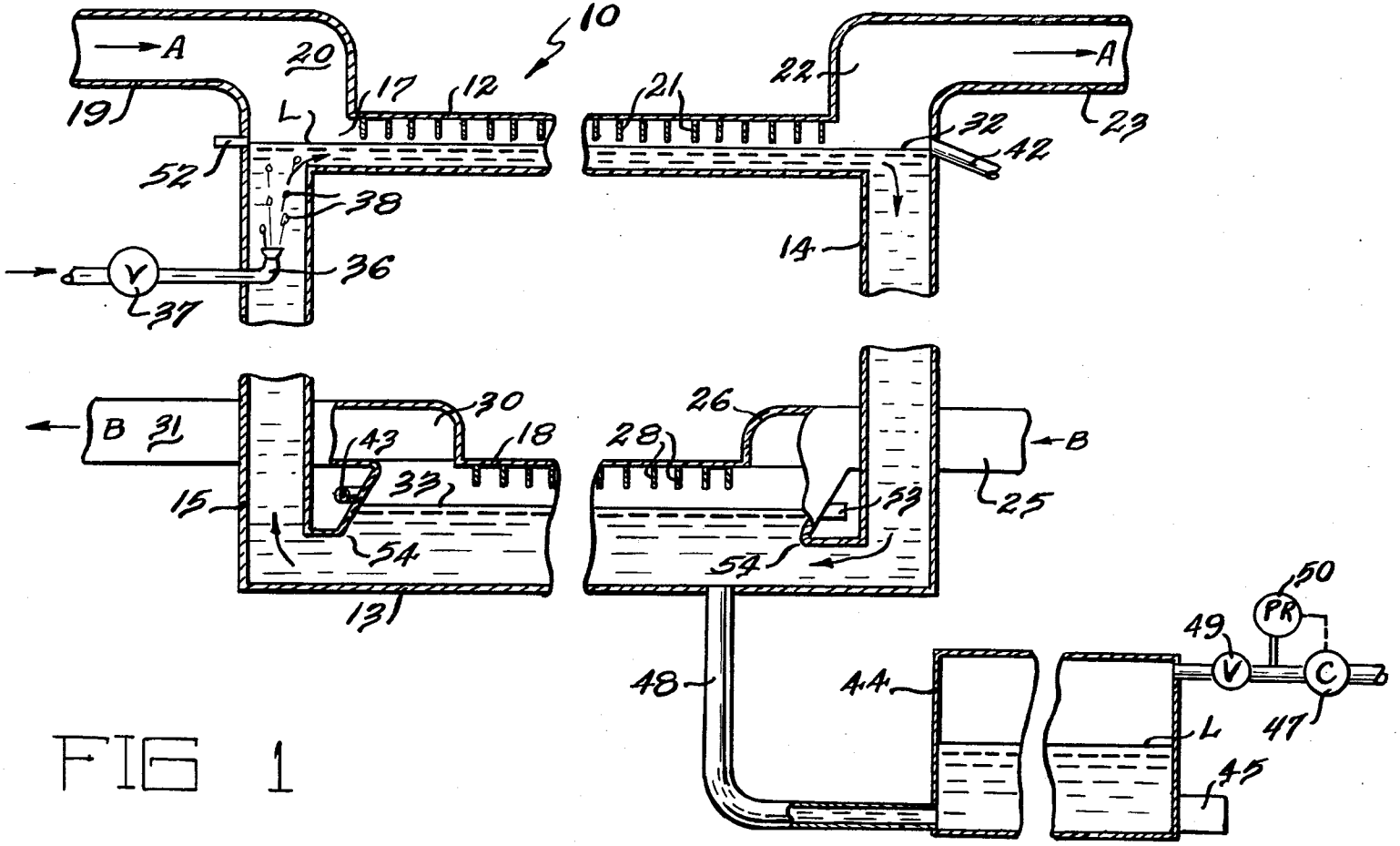
FIG. 1 is a schematic illustration of a preferred embodiment of the subject heat exchanger illustrating the loop configuration of the heat transfer media L as well as the inlet and outlet locations or lines for the separate fluids A and B.

Referring now to FIG. 1 of the drawings, a schematic flow circuit is shown of a preferred embodiment of the subject heat exchanger 10. The heat exchanger 10 is in the form of a continuous loop having a pair of separate and distinct channels 12 and 13 interconnected at opposite ends by a pair of separate and distinct columns 14 and 15. A heat transfer medium, such as a liquid L, is in the loop filling it except for the spaces or pockets 17 and 18 in channels 12 and 13, respectively, overlying the liquid. A line 19 to inlet manifold 20 to the channel 12 allows a first fluid, such as gas A, to be admitted to the channel 12. The gas A is directed through the channel and is discharged via outlet manifold 22 to line 23. Baffles 21 as illustrated (or other means) can be in the channel 12 to redirect the flow of the gas and/or improve the direct contact or intermixing between the gas A and heat transfer liquid L as the gas A moves through the channel 12. Line 25 to an inlet manifold 26 to the channel 13 allows a second fluid, such as gas B, to be admitted to the channel. The gas B is directed through the channel and is discharged via outlet manifold 30 to line 31. Baffles 28 as illustrated (or other means) can be in the channel 13 to redirect the flow of the gas and/or improve the direct contact or intermixing between the gas B and the heat transfer liquid L as the gas B moves through the channel 13.

It will be appreciated that the gases A and B are at different inlet temperatures, one being hotter than the other; and the heat exchanger is intended to cool the hotter gas and heat the cooler gas. In this regard, the heat transfer liquid L is selected to remain in the liquid phase in the exchanger loop, so that it thus has higher boiling and lower melting temperatures than the incoming temperatures of the gases A and B. Also, the heat transfer liquid must be practically insoluable and chemically stable in the presence of each gas A and B. The gases A and B, however, remain isolated from one another, so that this restriction, as between themselves, is not present. Moreover, except as otherwise will be noted later, each gas A and B also remains in its gas phase throughout its passage through the respective heat exchanger channel. The specific densities of the gases A and B are less than the specific density of the heat transfer liquid L so that each gas will normally be separated out from the liquid and collected at the respective outlet manifold 22 and 30 located above the liquid surface.

Each gas (A and B) and the heat transfer liquid L in each respective channel (12 and 13) are at comparable fluid pressures. By having each channel (12 and 13) extended along generally a single horizontal elevation, the pressure of the liquid L within that channel will be generally uniform along its entire length. If the channels 12 and 13 are kept at the same relative elevation, the pressures of the heat transfer liquid L would be comparable in each channel; and likewise the pressures of the gases A and B would be comparable. However, by locating the channels 12 and 13 vertically spaced apart, being interconnected by the columns 14 and 15, a head pressure differential within the heat transfer liquid L is established as between the lower and upper channels. The pressures of the gases A and B will thus be different also.

When the heat exchanger 10 is filled with a dense heat transfer liquid, such as copper oxide ($Cu_2O$ having a specific gravity of 6.4), a significant pressure differential can be established over a relatively small height difference as between the channels 12 and 13. For example, by having the upper channel 12 elevated above the lower channel 13 by a distance of approximately eight meters, a head pressure differential as between the lower and upper channels is approximately five atmospheres. Thus, if the pressure in the upper channel 12 is approximately at one atmosphere, the pressure in the lower channel 13 would be of the order of six atmospheres.

The pressure of either gas A or B at its respective inlet (20 for channel 12 and 26 for channel 13) would be greater than but comparable to the pressure of the heat transfer liquid L at that location within that respective channel. Likewise the pressure of either gas A or B at its outlets (22 for channel 12 and 30 for channel 13) would be less than the pressure of the same gas and its corresponding channel inlet (20 or 26). The pressure differential between the inlet and outlet locations for either gas A or B need only be sufficient to move the gas through the channel, which typically will be less than 0.05–0.1 atmospheres. Each outlet (22 or 30) is located at an elevation vertically above the level 32 or 33 of the heat transfer liquid L in the channel so that the heat transfer liquid does not become entrained in the gas discharge (at line 23 or 31) from the channel. The pressure of the gas A or B at its outlet is generally similar to the surface pressure of the heat transfer liquid in the respective channel.

Inasmuch as the gases A and B enter the heat exchanger 10 and contact or admix directly with the heat transfer liquid L therein, there is very effective heat transfer as between each gas A or B and the liquid L, and vice versa. It will be appreciated that either gas A or B can be the hotter gas; and the other of course will be the cooler gas. Moreover, the heat transfer can be continuous, with continuous flows of the gases A and B through the channels and with continuous circulation of the heat transfer liquid L unidirectionally around the heat exchanger loop. In this regard the gases are forced through each respective channel because the pressure differential as between the gas inlet and the outlet; whereas the heat transfer liquid can be circulated unidirectionally around the loop because of the movement of the gases through the channels and/or because of gas injector means 36 located in one of the loop columns.

The gas injector means 36 is shown in column 15 and extends the width of the column and has upwardly open nozzle outlets. A gas, such as air, under high pressure can be controlled by valve 37 and discharged with vertical upward components from the nozzle outlets to induce accompanying upward movement of the heat transfer liquid L. The gas discharge from the injector means further resolves into bubbles 38 that rise and create a bubble pump action vertically in the column 15. Moreover, the bubbled heat transfer liquid in column 15 is less dense than the nonbubbled heat transfer liquid in column 14 so that this differential in column mass as seen across the interconnecting lower channel 13 further contributes to the effective circulation of the heat transfer liquid unidirectionally around the closed loop (clockwise as referenced in FIG. 1). The injected gas would be separated out from the heat transfer liquid L in channel 12 and be discharged through the outlet 22. The pressure, velocity and mass discharge of the gas from the injector means 36 would be selected sufficient to circulate the heat transfer liquid continuously around the loop; but the energy required to do this would normally be less than 0.1% of the overall energy exchange of the heat exchanger.

Inasmuch as the gas injector means 36 admits gas into the heat exchanger loop that comingles with the gas A in the channel 12 and/or the outlet 22, it should be compatible with the gas A and further not be detrimental to the purity, if such is required, of gas A at the outlet 22. In point of fact, the gas used in the injector means 36 can be gas A if purity at output 22 is a prerequisite to the operation of the fluid cycle within which the heat exchanger 19 is located. If not, air might be preferred because of its abundance and ease of pressurizing.

A major advantage of the direct interchange or contact between each gas and the liquid is that the cooler gas can be heated to temperatures very close to the hotter gas; and the absolute temperatures of gases can be quite high. For example, if the heat transfer liquid L were a molten substance such as copper oxide ($Cu_2O$), or a molten metal such as copper (Cu), the interchange of heat can be made up to temperatures in excess of 1800° C. Other heat transfer mediums can be used also, such as the molten salts sodium chloride (NaCl) or potassium chloride (KCl), or the glasses containing silicon oxide ($SiO_2$), alumina ($Al_2O_3$), calcium oxide (CaO), or coal slag, and the like.

The direct intermixing or comingling of the gases with the heat transfer liquid provides yet another most useful advantage, which is that impurities entrained in either of the gases A or B can be condensed out of the gas as liquid and/or solid particulates and separated out. For example, combustion gases generally have therein a slag that has a condensation temperature in the range of 1500°–1600° C., that by holding the heat transfer liquid L below but near this range of temperatures, the slag can be condensed out. The slag typically has a specific gravity of approximately 1.5–3.0, which would be less than that of the heat transfer liquid L, for example copper oxide ($Cu_2O$) having a specific gravity of 6.4, or copper (Cu) having a specific gravity of 8.1. Thus, the slag condensate would float to the surface of the heat transfer liquid L and could be separated out by flotation over a weir type outlet 42 (see FIG. 1) located in the upper channel 12. It is possible that some portion of the condensate could dissolve in the heat transfer liquid L, but the heat transfer characteristics of the exchanger should not be substantially altered.

Another most important aspect of the liquid-gas heat exchanger 10 is that the relative vertical location of each channel 12 and 13 dictates the pressure differential of the heat transfer liquid L in the channels. This of course would dictate the pressures of the gases A and B passing through the heat exchanger; but it allows the interchange, when once established, of gases at different pressures and at extremely diverse and/or high temperatures.

Also illustrated is a reservoir 44 for the heat transfer liquid L. The reservoir 44 would have sufficient volume to hold all of the heat transfer liquid L when the system is not in use. The heat transfer liquid L could be brought to or maintained in its molten state by the heat output from a secondary source, such as furnace 45. A compressor 47 is used then to pressurize the reservoir sufficiently for pumping the liquid via the line 48 into the closed loop. A control valve 49 at a relatively cool zone can be operated in connection with a pressure regulator 50 in the reservoir and sensors 52 and 53 in the channels 12 and 13 respectively for maintaining sufficient liquid in the heat exchanger loop and the liquid at the proper surface heights relative to the channels.

It will be appreciated that the level of the liquid L at surface 33 (FIG. 1 for example) in the lower channel 13 is always kept higher than the lower corners 54 of the channel walls so as to isolate the gas B from the columns 14 and 15. This of course is accomplished by having the pressure of the gas B less than the liquid pressure at the corner. The pressure of gas B will approximately be the cumulative head pressure between the liquid surfaces 32 and 33 plus the pressure of gas A.

The heat exchanger 10 illustrated in FIG. 1 is of the parallel flow type where each gas A and B and the heat transfer liquid L flow in the same relative direction within each respective channel. The parallel flow of the gases A and B through the channels 12 and 13 respectively serve also, at least in part, as a moving force for circulating the heat transfer liquid unidirectionally around the loop.

Figure 2:
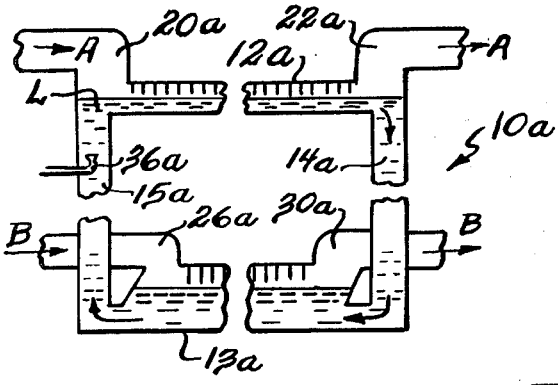
FIGS. 2, 3 and 4 are variations of the heat exchanger illustration in FIG. 1 having different parallel or counterflow arrangements relative to the figure.
Figure 3:
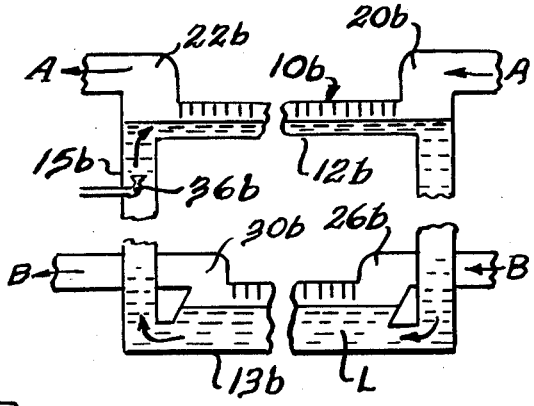
Figure 4:
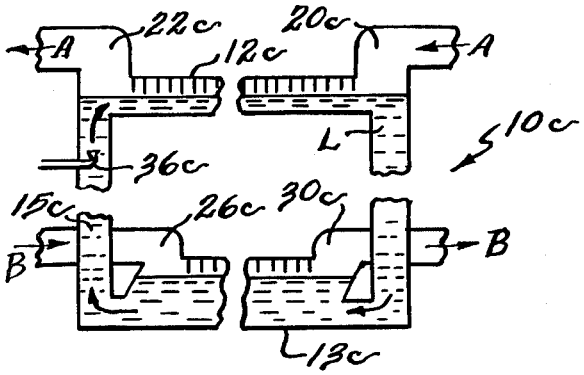

Various types of gas movement relative to the heat transfer liquid are possible other than the parallel flow arrangement of FIG. 1, and some of these are illustrated schematically in FIGS. 2, 3 and 4. For example, in heat exchanger 10*a* (see FIG. 2) air injector means 36*a* in column 15*a* circulates the heat transfer liquid L in a clockwise direction around the loop; and gas A moves through the heat exchanger channel 12*a* from inlet 20*a* to outlet 22*a* in the same direction (parallel flow) as the heat transfer liquid L moves through channel 12*a*, whereas the gas B moves through the channel 13*b* from the inlet 26*a* to outlet 30*a* in the opposite direction (counterflow) as the heat transfer liquid L moves through the channel 13*a*. This would expose the exiting gas B to the heat transfer liquid directly received via column 14*a* from the gas A channel 12*a*, and would provide a smaller temperature difference as between the incoming gas A and the exiting gas B when compared to the pure parallel flow of FIG. 1.

FIG. 3 illustrates heat exchanger 10*b* wherein air injector means 36*b* in column 15*b* would circulate the heat transfer liquid L in a clockwise direction around the loop; and gas A is moved axially through channel 12*b* from inlet 20*b* to outlet 22*b* in counterflow direction to the movement of the heat transfer liquid L through the channel; while gas B is moved axially through channel 13*b* from inlet 26*b* to outlet 30*b* in a parallel flow direction with the heat transfer liquid L moving through the channel. This arrangement not only provides a smaller temperature difference as between the incoming gas A and the exiting gas B (when compared to FIG. 1), but the flow of gas B through the channel 13*b* helps the injection means 36*b* circulate the heat transfer liquid L continuously around the heat exchanger loop.

FIG. 4 illustrates heat exchanger 10*c* wherein both the gases A and B are moved through their respective channels 12*c* and 13*c* in counterflow relation to the flow of the heat transfer liquid L through the channels and around the loop. This would provide for the most effective heat transfer as between the gases and the heat transfer liquid and/or the smallest temperature differences between the incoming and exiting gases A and B. However, it would require the largest output from the ejector means 36*c* in column 15*c* in order to circulate the heat transfer liquid L continuously about the loop. The gas A inlet 20*c* and outlet 22*c*, as well as the gas B inlet 26*c* and outlet 30*c* are also identified.

Figure 5:
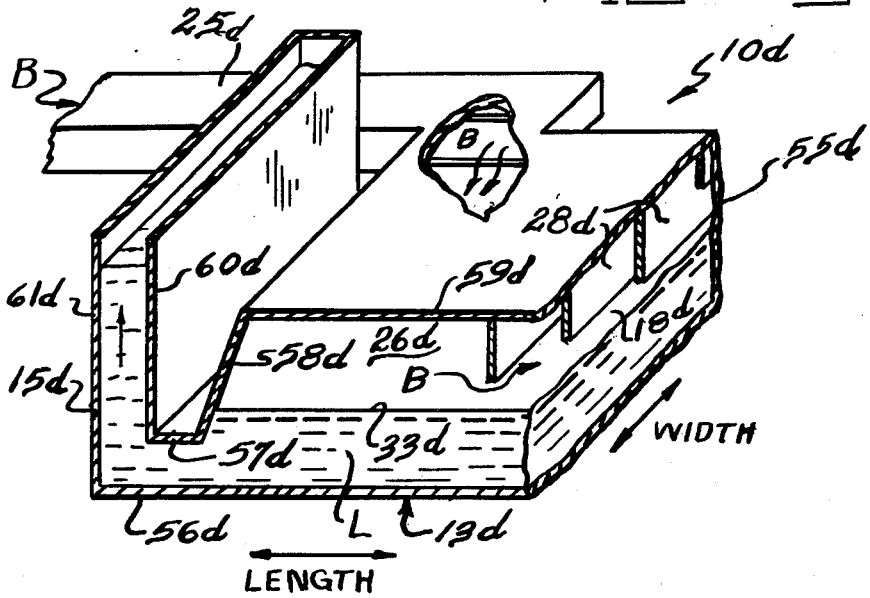
FIG. 5 is a perspective view of part of a typical heat exchanger construction which might be applicable for any of the heat exchangers illustrated in FIGS. 1–4.

FIG. 5 illustrates in perspective a typical heat exchanger construction which might be applicable for any of the heat exchangers thus far described and illustrated schematically. The heat exchanger 10*d* has a finite width as indicated, with vertical sidewalls 55*d* (only the remote one being shown) interconnecting the horizontal and sloping bottom and top walls 56*d*, 57*d*, 58*d*, and 59*d* of the respective channels (only the lower channel 13*d* being illustrated) as well as the vertical inner and outer cross walls 60*d* and 61*d* of the columns (only column 15*d* being illustrated). Each channel is larger in cross section, as compared to either column, to accommodate the simultaneous movements of both the heat transfer liquid L and the respective gas A or B. The inlet to and the outlet from the upper channel (not shown in FIG. 5) can be from inlet and outlet lines extended axially in the direction of the channel, (since the columns are not of concern), but would open into a manifold that communicates the gas uniformly across the channel width. The lower channel 13*d* as illustrated provides that the inlet line 25*d* (or outlet line, depending only on the direction of the gas flow therethrough) is laterally offset from the column 15*d* and communicates with a full channel width inlet 26*d* from the side and at a location above the heat transfer liquid surface 33*d*. The channel 13*d* in turn is comprised of a lower section for the heat transfer liquid L and an upper pocket or space 18*d* defined above the surface 33*d* of the heat transfer liquid for accommodating the gas movement through the channel. Separate baffles 28*d* are also illustrated in spaced relation axially of the path of movement of the gas B.

Figure 6:
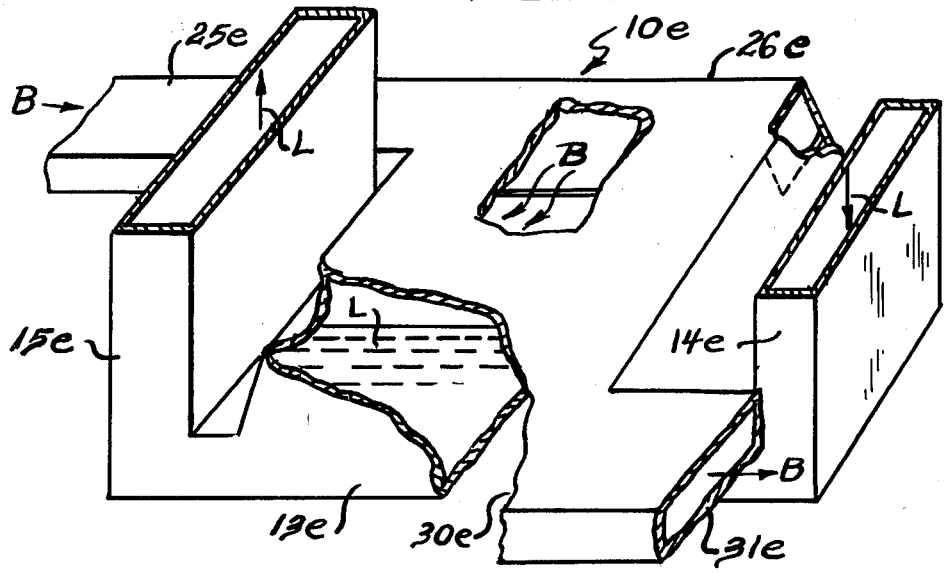
FIG. 6 is a perspective view of part of a modified heat exchanger which would have a crossflow characteristic as between the flow of the liquid L and the passage of the fluid B.

A cross flow heat exchanger 10*e* is illustrated in FIG. 6, where the inlet and outlet manifolds (26*e* and 30*e*) communicate with the lower channel 13*e* along opposite sides (being open to the channel almost along the entire channel length) while the channel 13*e* also is extended axially between the separate loop columns 14*e* and 15*e*. The heat transfer liquid would flow axially through the channel from one column 14*e* to the other column 15*e*; while gas B would flow crosswise to this liquid movement from the inlet manifold 26*e* on one side of the channel 13*e* to the outlet manifold 30*e* at the opposite side of the channel. The inlet line 25*e* and outlet 31*e* for the gas B also is identified.

The characteristic temperature differences of the incoming hot and cold gases and the exiting cooled and heated gases can be selected upon varied incorporation of the liquid-gas flow arrangements illustrated herein.

Figure 7:
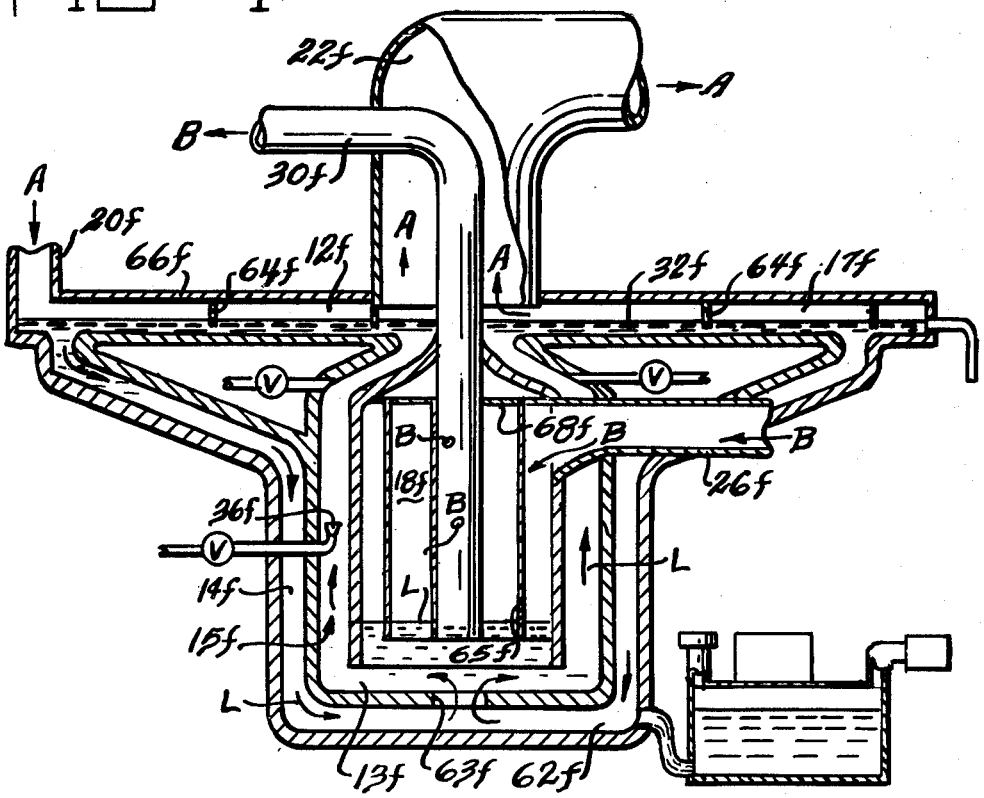
FIG. 7 is a schematic illustration of yet another modified heat exchanger wherein each fluid A and B is caused to traverse in a spiral configuration relative to the underlying liquid circulated throughout the endless loop.

FIG. 7 illustrates yet a further modification of a heat exchanger 10*f* where the upper and lower channels (12*f* and 13*f*) are formed radially of a common vertical axis, and where the separate vertical columns (14*f* and 15*f*) extended between the opposite ends of the channels are formed concentrically of one another. The heat transfer liquid L is circulated unidirectionally for example, in the directions of the arrows by operation of the gas injector means 36*f* in column 15*f* where the liquid would rise in inner vertical column 15*f* to enter near the center of the upper channel 12*f* and would flow radially outwardly therefrom to the outer extremity of the upper channel whereupon the liquid would then flow down outer column 14*f* to a radial passage 62*f* underlying the lower channel 13*f* and would flow upwardly through a central opening 63*f* into the lower channel 13*f* and radially outward therefrom to the lower end of the inner column 15*f* to complete the closed loop.

Gas A would be directed by a continuous spiral wall. 64*f* to flow through pocket 17*f* over the liquid in the channel 12*f* from an outer inlet manifold 20*f* around a spiral path at decreasing distances from to the center to central outlet manifold 22*f*. Gas B would likewise be directed by a continuous spiral wall 65*f* to flow through pocket 18*f* over the liquid in the channel 13*f* from an outer inlet manifold 26*f* around a spiral path at decreasing distances from the central outlet manifold 30*f*. The vertical spiral walls 64*f* and 65*f* for defining the separate spiral gas flow passages 17*f* and 18*f* would extend from the top horizontal channel walls 66f and 68f respectively to only slightly below or near the surfaces 32f and 33f of the liquid in the channel. Each gas would thereby be forced to move in its spiral path over the liquid; whereas the liquid itself would circulate through each channel in a radially outward manner as illustrated. This creates a liquid-gas cross flow-counterflow arrangement. A weir type separator 42f for discharging the slag or other impurities condensed from gas A in the heat transfer liquid L is also illustrated.

It is possible to reverse the direction of flow of the liquid L, or of either and/or both of the gases A and B, to provide varying combinations of heat transfer characteristics with the flow paths illustrated in FIG. 7, as has been noted with respect to FIGS. 1–4.

Figure 8:
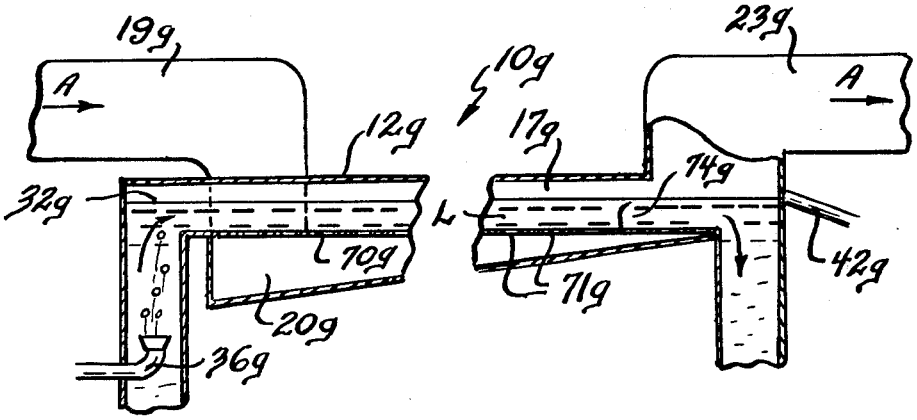
FIG. 8 is a schematic illustration of part of yet another modified heat exchanger wherein the fluid A is bubbled through the heat transfer liquid as it passes through the respective heat exchanger channel.

FIG. 8 illustrates a heat exchanger 10g having modified channel 12g that has a gas inlet manifold 20g located across the bottom of the channel below an intermediate baffle wall 70g and outlet openings 71g are formed in this wall. The heat transfer liquid L would overlie the wall 70g and would occupy a middle part of the channel up to surface 32g and a gas space or pocket 17g would yet exist above the surface of the heat transfer liquid. This would necessitate that all of gas A flowing through the channel 12g from the inlet line 19g to the outlet line 23g would bubble through the liquid to reach the gas space 17g, thereby ensuring a highly effective heat transfer as between the liquid and the gas. This bubbling system could of course be incorporated in addition to and/or in place of the baffles illustrated in any of the previous embodiments. It is further possible by locating a deflector (only one being shown at 74g) adjacent each gas outlet opening 71g to impart an axial component to the gas discharge, which would assist the parallel flow movement of the heat transfer liquid through the channel and around the heat exchanger loop. However, of course, in a counter or cross flow gas-liquid channel, all deflectors 74g would be eliminated to minimize resistance against the movement of the heat transfer liquid through the channel. The gas injector means 36g for circulating the heat transfer liquid L around the loop and the slag discharge weir 42g are also illustrated.

Figure 9:
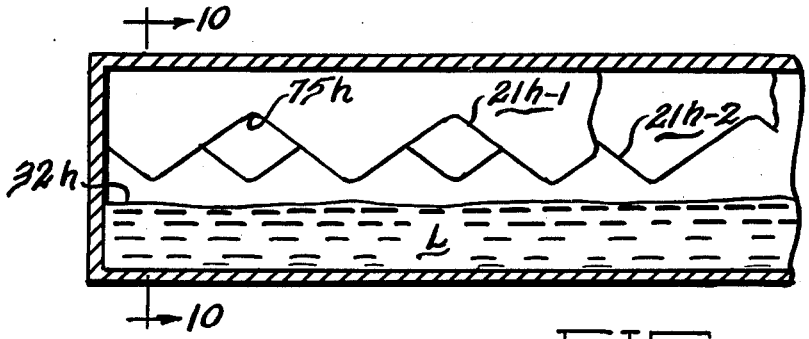
FIGS. 9 and 10 are channel oriented axial and cross sectional elevational views as seen from line 10—10 in Fig. 9 respectively of a typical baffle construction which can be used in any of the heat exchangers thus far illustrated.
Figure 10:
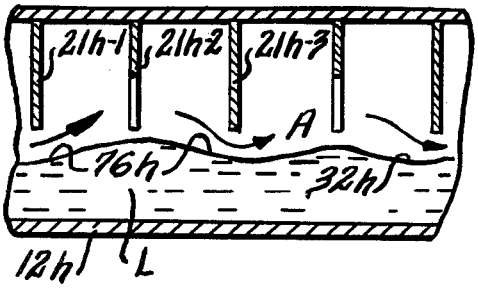

Various forms of baffling and/or bubbling means are possible for providing improved heat transfer characteristics as between the heat transfer liquid L and the gas A or B moving through the channel. One specific design of baffles (FIGS. 9 and 10) could have a saw tooth or wavy lower edge, and the separate baffles (such as those identified in Fig. 10 as 21h-1, 21h-2, and 21h-3) spaced apart axially of the channel can be arranged to stagger the saw teeth of each baffle laterally relative to one another. The lower baffle edge could be located near the surface 32h of the heat transfer liquid in the respective channel—just slightly above, even with, or perhaps below it—but the apex 75h between each two adjacent saw teeth would typically be located above the liquid surface. With this general arrangement, much of the gas A flowing through the channel 12h would be directed by the baffles in a back and forth or cross flow pattern in the space above the liquid surface 32h, contacting the liquid surface as each medium moves also axially along the channel between the respective inlet and the outlet. The gas flow would typically be at a relatively high velocity and would create turbulence and/or waves along the liquid surface, which would provide for good heat transfer characteristics. Also, the pressure differential of the gas across the lower edge of each baffle in fact could drive the gas through the heat transfer liquid (as at depression 76h in FIG. 10) as it is passed around that baffle. This again would provide effective heat transfer contact between the heat transfer liquid and the gas.

Figure 11:
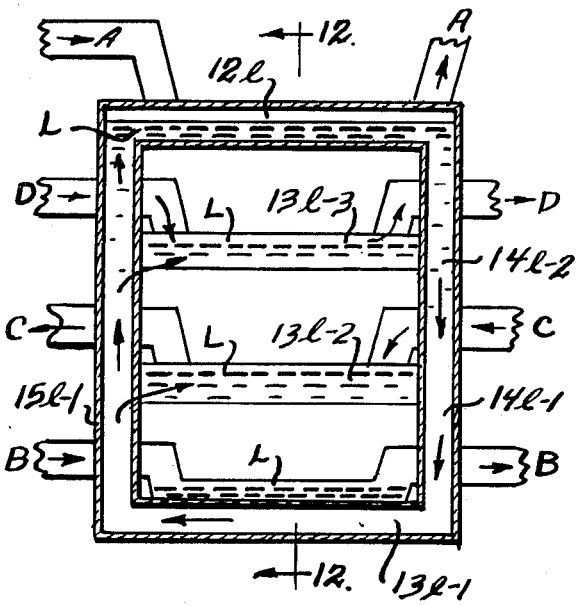
FIGS. 11 and 12 are schematic representations of the loop type configuration heat exchanger illustrated which might be applicable for having four different fluids A, B, C and D, respectively, entering and exiting the heat exchanger in isolation one from the other and benefiting from the heat exchanger of the common heat transfer liquid L.
Figure 12:
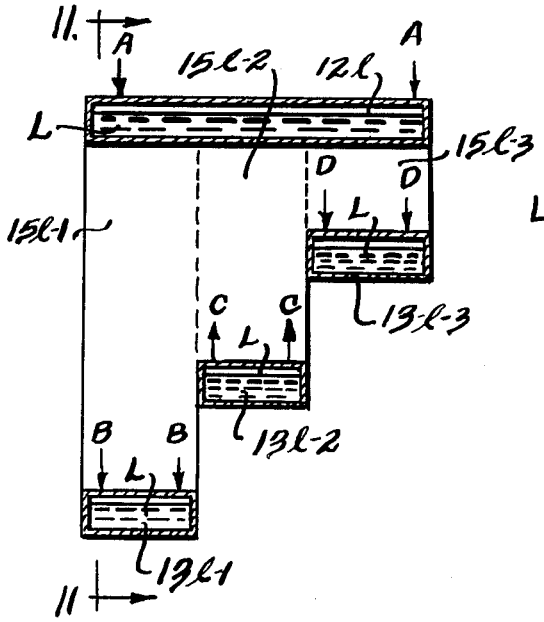

Yet another modified heat exchanger 10l is illustrated in FIGS. 11 and 12 where each spaced vertical column is comprised of several cross sections of different widths, and column sections 14l-1 and 14l-2 extend between the upper channel 12l and the lower channel 13l-1; while the other column sections (only 15l-2 and 15l-3 being identified) are diverted off to intermediate lower channels 13l-2 and 13l-3, respectively.

Different gases A, B, C and D could be passed in isolation through the channels 12l, 13l-2 and 13l-3, respectively, with each being at a different pressure. It would also be possible to have separate equal level channels (not shown) and have a divider to maintain two overlying gases isolated from one another. The columns could be actually subdivided structurally, by an axially extended barrier or divider (not shown) so as to provide isolated but parallel liquid flows in the columns to preclude the convective and mingling heat transfer of the liquid to varying adjacent factors of the liquid. Of possible interest also is to provide multiple pass gas flow through the channel from the inlet to the outlet to produce greater heat transfer effectiveness between the gas and liquid.

While the heat exchangers thus far disclosed have had fluids A and B in the form of gases, and moreover have had the gases of lesser density than the heat transfer liquid L, other variations are possible. For example, with immiscible liquids A and L or B and L, the liquid A or B could be mixed directly with the heat transfer liquid L and be separated therefrom in the channel by the differential in specific gravity before travelling over to the adjacent column. Also, it would be possible to admit either fluid A or B in the form of a liquid, where the liquid A or B could then vaporize and be discharged from the heat exchanger channel in the form of a gas of lesser specific gravity than the heat transfer liquid.

Figure 13:
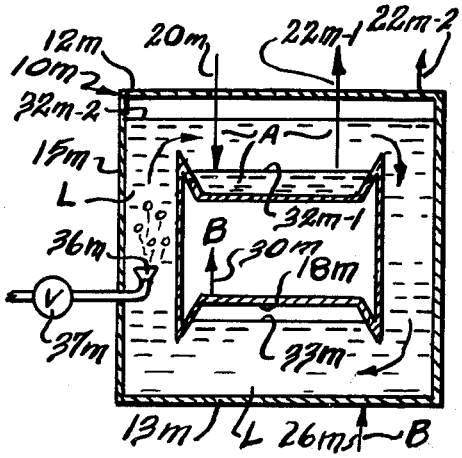
FIG. 13 is yet another illustration in schematic of a heat exchanger wherein the relative densities of the fluids A and B with respect to the heat transfer liquid L might differ from those illustrated previously.

These concepts are illustrated in FIG. 13 with heat exchanger 10m, where liquid A would be more dense than the heat transfer liquid L and would be admitted via inlet 20m to channel 12m inwardly of column 15m to flow with the heat transfer liquid; but would be separated out and discharged from the pocket 17m via outlet 22m-1. The pressure of the exiting liquid A at the outlet 22m-1 would be greater than the pressure of the heat transfer liquid at the surface juncture 32m-1 between the liquids A and L. Fluid B could be admitted via inlet 26m to channel 13m (as a liquid or as a gas) but would vaporize in the channel and collect in pocket 18m and be discharged via outlet 30m from the channel. The surface 33m of liquid L is also identified. The heat transfer liquid L would be circulated around the loop by pressurized air being admitted via valve 37m to injector 36m to bubble up through the liquid in column 15m and be discharged from the channel 12m via outlet 22m-2 located above the top surface 32m-2 of the liquid L.

Figure 14:
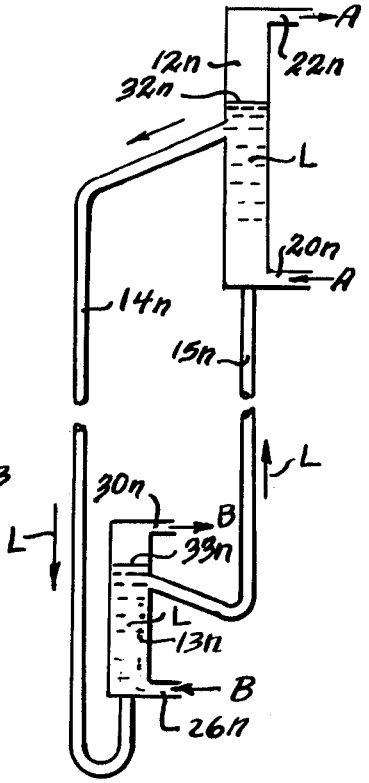
FIG. 14 is a schematic illustration of yet another form of the heat exchanger wherein the channels are illustrated in vertical orientation.

Heat exchanger 10n is illustrated in FIG. 14 where the channels 12n and 13n are oriented vertically, and the columns 14n and 15n also extend vertically and directly into and from these channels. As illustrated, each fluid A and B is admitted via inlets 20n and 26n in the form of a gas having a density lighter than that of the heat transfer L so that the outlets 22n and 30n respectively for the gas would be located above the surface 32*n* and 33*n* of the liquid in the channel. The gases bubbling through the heat transfer liquid L in each channel would move the liquid around the loop, upwardly in column 15*n* and downwardly in the column 14*n*.

If hot temperatures are to be encountered in the heat exchanger, the confining walls might be formed with an outer skin of structural material and an inner refractory liner that would insulate the structural skin from the temperatures of the heat transfer liquid and/or gases. A suitable refractory having a melting temperature in excess of 2000° C. would be alumina ($Al_2O_3$), which further possesses exceptional strength and resistance against abrasion, corrosion or the like. Other refractions might include silicon carbonate (SiC) or boron nitrite (BN), each of which has a melting temperature in excess of 2700° C. It is possible that certain dissolving of the refractory could take place over time in the various moving fluids; however, this should not adversely affect the effectiveness in transferring heat from one fluid to the other. Alternatively, the structural walls could be formed of a high grade steel or the like with coolant passages formed on them so that the walls might be cooled by a circulating coolant such as a liquid metal, a molten salt, steam or the like. This would maintain the structural integrity of the walls even though they might normally deteriorate at such high temperatures were they not otherwise cooled. Of course, an inner refractory line can be used to isolate even further the structural walls from the high temperature fluids. These structural adaptations of having the refractory lined structural wall, the coolant-cooled wall, and/or a combination of these could be used for the baffles as well.

It is thus noted that the disclosed heat exchanger can provide for the heat interchange of two, three or more separate gases, each operating at similar and/or different pressures and having different incoming and exiting temperatures. Specific examples of each of these concepts, however, need not be given in order to understand them and the beneficial flexibility of the heat exchanger insofar as its ability to handle varying numbers of gases at varying pressures and varying temperatures.

The embodiments of the invention in which an exclusive property or privilege is claimed are defined as follows:

1. A heat exchanger, comprising structure having upper and lower horizontally disposed channels and separate vertically disposed columns interconnected between opposite ends of the channels thereby defining a closed loop, a flowable heat transfer liquid within the loop and completely filling the columns and filling each channel across the bottom thereof to and between the liquid in the columns, spaced inlet and outlet means to each channel at locations above the upper surface level of the heat transfer liquid therein, means for directing a first fluid via the appropriate inlet means into the upper channel and for moving the first fluid in direct contact with the heat transfer liquid therein and for withdrawing the first fluid via the appropriate outlet means from said upper channel, means for directing a second fluid via the appropriate inlet means into the lower channel and for moving the second fluid in direct contact with the heat transfer liquid therein and for withdrawing the second fluid via the appropriate outlet means from the lower loop channel, the pressure of the heat transfer liquid in the lower channel being greater than the pressure of the heat transfer liquid in the upper channel by a factor corresponsing to the column head of the liquid between the liquid surfaces in the channels, and means for continuously and unidirectionally circulating the heat transfer liquid around the loop, whereby the hotter of the fluids continuously transfers heat to the heat transfer liquid which in turn continuously transfers heat to the cooler of the fluids.

2. A heat exchanger combination according to claim 1, wherein each of the columns is extended in an uninterrupted fashion and without directional backfolds on itself between the upper and lower channels.

3. A heat exchanger combination according to claim 1, wherein the lower channel has wall structure defining the confinement for the second fluid above the surface of the heat transfer liquid therein, and the wall structure also is extended below the liquid surface to terminate adjacent the lower open ends of the respective adjacent columns.

4. A heat exchanger combination according to claim 3, wherein each of the columns is extended in an uninterrupted fashion and without directional backfolds on itself between the upper and lower channels.

5. A heat exchanger combination according to claim 1, wherein at least one of the first and second fluids is discharged into its respective channel in an axial direction and with sufficient pressure and mass flow so as to serve as a means for moving the heat transfer liquid around the loop.

6. A heat exchanger combination according to claim 1, further including injector means operable for discharging into one of the columns a gas having a lesser density than the heat transfer liquid for bubbling upwardly in the column and thereby moving the liquid around the loop in the same direction.

7. A heat exchanger combination according to claim 1, wherein the means for directly contacting or admixing either fluid with the heat transfer liquid includes the formation in the respective channel of baffle structure that redirects the relative movement of the fluid and heat transfer liquid.

8. A heat exchanger combination according to claim 1, wherein the first fluid has impurities therein that condense out into the heat transfer liquid as the first fluid is passed through the upper channel, and wherein separator means in the upper channel thereby allow for the removal of the condensated impurities from the upper channel substantially isolated from both the first fluid and heat transfer liquid.

9. A heat exchanger combination according to claim 1, wherein the heat transfer liquid operates at temperatures generally between 1200° C. and 1800° C., and wherein the exiting temperatures of both the hot and the cold fluids are generally in this temperature range.

10. A heat exchanger combination according to claim 1, wherein the first fluid moves in the upper channel in a parallel flow with the heat transfer liquid moving through the upper channel.

11. A heat exchanger combination according to claim 1, wherein the first fluid moves in the upper channel in a crosswise flow to the heat transfer liquid moving through the upper channel.

12. A heat exchanger combination according to claim 1, wherein the first fluid moves in the upper channel in counterflow to the heat transfer medium moving through the upper channel.

13. A heat exchanger combination according to claim 1, wherein the first fluid moves in the upper channel in cross flow-counterflow relation with the heat transfer medium moving through the upper channel.

14. A heat exchanger combination according to claim 1, wherein the specific gravity of the heat transfer medium is greater than the specific gravity of the first fluid, whereby the first fluid will separate out from the heat transfer medium in the upper channel along a top surface of the medium, and wherein the outlet means to the upper channel is located at a height above the surface of the heat transfer medium in the channel so that the head pressure of the heat transfer medium at this location would be less than the localized pressure of the first fluid to the extend that no heat transfer medium is present at said outlet means.

* * * * *